United States Patent [19]

Eiselt et al.

[11] 3,967,852

[45] July 6, 1976

[54] UPHOLSTERING BODY HAVING A SUPPORTED CORE IN THE FORM OF A YIELDABLE PLATE OF SYNTHETIC MATERIAL AND A RESILIENT LAYER ON THE CORE

[75] Inventors: Günter Eiselt; Rudolf Hossbach, both of Unkel, Germany

[73] Assignee: Günter Eiselt, Unkel, Germany

[22] Filed: Feb. 26, 1975

[21] Appl. No.: 553,258

Related U.S. Application Data

[62] Division of Ser. No. 377,735, July 9, 1973, abandoned.

[30] Foreign Application Priority Data

July 7, 1972 Germany ..... 2233389
Oct. 13, 1972 Germany ..... 2250249

[52] U.S. Cl. ..... 297/452; 297/455; 297/DIG. 1

[51] Int. Cl.[2] ..... A47C 7/02

[58] Field of Search ..... 297/DIG. 1, DIG 2, 452, 297/455, 456, 458–460

[56] References Cited

UNITED STATES PATENTS

| | | | |
|---|---|---|---|
| 1,461,497 | 7/1923 | Robbins | 267/41 X |
| 2,530,924 | 11/1950 | Turner | 297/458 X |
| 3,127,220 | 3/1964 | Stine | 297/456 X |
| 3,140,086 | 7/1964 | Lawson | 297/DIG. 1 |
| 3,270,393 | 9/1966 | Levenson | 297/DIG. 2 |

*Primary Examiner*—James C. Mitchell
*Attorney, Agent, or Firm*—Walter Becker

[57] ABSTRACT

An upholstering body for use as the seat, or back, or as a combination seat and back in an article of furniture in which the body has an outer layer of resilient material such as a foamed elastomeric material and a supporting core member in the form of a sheet, or plate, of synthetic material, polyester resin, for example. The sheet is preferably reinforced with glass fibers, which may be in the form of glass cloth. The sheet is adapted for anchoring to a furniture frame in such a manner that the sheet is yieldable in the direction in which a load is normally applied thereto while being generally unyieldable in other directions.

19 Claims, 29 Drawing Figures

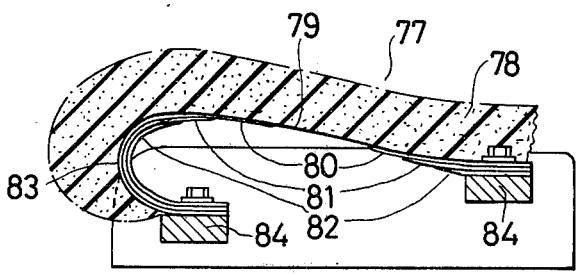
Fig. 15
Fig. 16
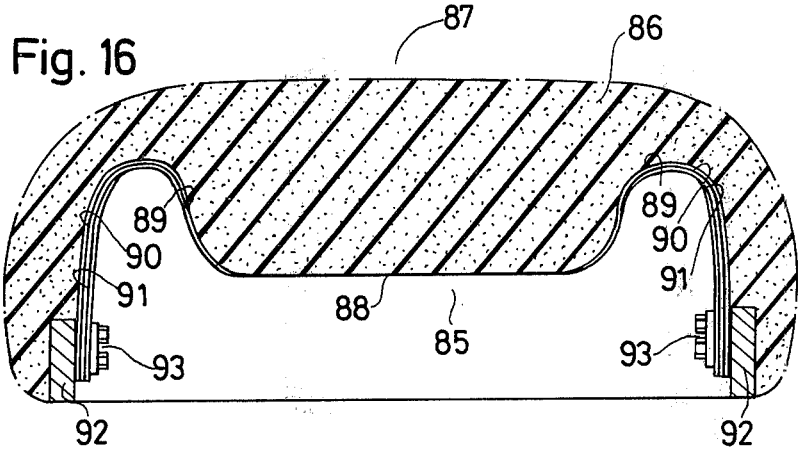
Fig. 17
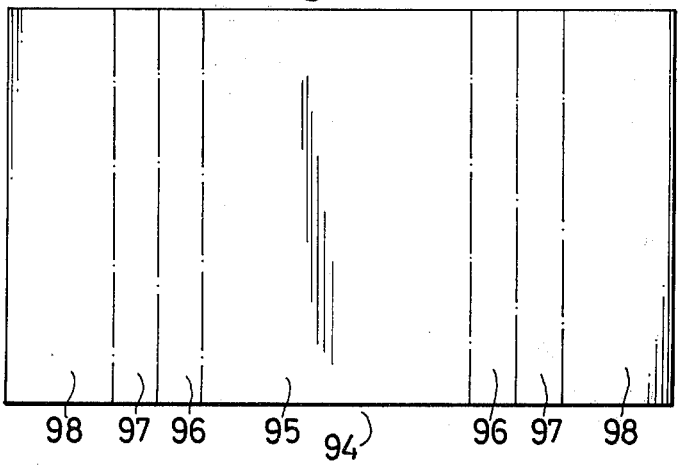

UPHOLSTERING BODY HAVING A SUPPORTED CORE IN THE FORM OF A YIELDABLE PLATE OF SYNTHETIC MATERIAL AND A RESILIENT LAYER ON THE CORE

This is a division of co-pending application Ser. No. 377,735—Eiselt et al. filed July 9, 1973 (Monday), now abandoned.

For the manufacture of upholstering bodies, especially for seats or sit-on and similar pieces of furniture, the tendency exists to use, if possible, exclusively synthetic materials while reducing the number of individual elements to a minimum in order to keep the manufacturing costs low and to allow a fast and simplified production of such furniture pieces and the like. Thus, upholstering bodies and similar furniture pieces have become known which consist exclusively of foam material and in which in a body of foamed material there is formed-in an inner foamed body which is designed in conformity with the shape and function of the piece of furniture to be made. Such known upholstering body does for its manufacture require a considerable amount of foam material with partly high volumetric weight which greatly influences the manufacturing costs. A good resiliency of the surfaces to be loaded cannot be realized with such an upholstering body. To reduce the required quantity of foam material, it is also known to provide an upholstering body, comprising an upholstering layer and a core, with a core consisting of a resilient hollow body of thermoplastic synthetic material, which hollow body is produced according to the deep drawing or blow-pressure method and may be provided with a peripheral bottom edge and, if desired, with reinforcing ribs or with perforations and may be covered with plates of foam material or of latex-foam material or may be laminated with a form-foamed cap, while the core may consist of one or more pieces. With this upholstering body no material resiliency of the loaded surface or of the surface to be loaded can be realized because the hollow body which is closed all the way with the exception of the bottom opening and forms the core does not permit a displacement or shifting of the surface which substantially absorbs the load. Futhermore, the utilized thermoplastic material is not suitable at the same time to absorb relatively high loads and to permit major spring strokes. For purposes of improving the spring properties, it has been suggested to provide slits in the surface to be loaded. This step, however, increases the danger of breaking and also decreases the strength of the thermoplastic foil in this region. Furthermore, for producing hollow bodies of this kind, expensive tools are required which makes the manufacture of such upholstering bodies economically feasible only when large quantities are to be produced.

It is, therefore, an object of the present invention to provide an upholstering body which, while requiring relatively small quantities of material and being able to be produced in a simple manner, can absorb considerable loads while permitting larger spring strokes of the surface to be loaded than is possible with heretofore known upholstering bodies.

This object and other objects and advantages of the invention will appear more clearly from the following specification in connection with the accompanying drawings, in which.

FIGS. 9–12 respectively illustrate additional embodiments of plate-shaped bodies according to the invention for making upholstering bodies for sofas and similar pieces of furniture.

Figure 13:
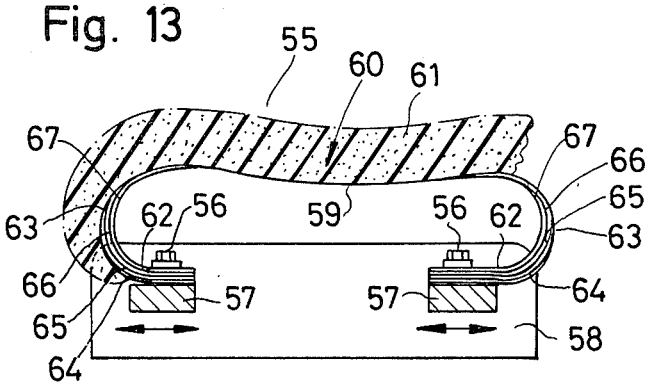

FIG. 13 diagrammatically illustrates in side view and in section another plate-shaped body according to the invention which is suitable for a chair or similar piece of furniture.

Figure 14:
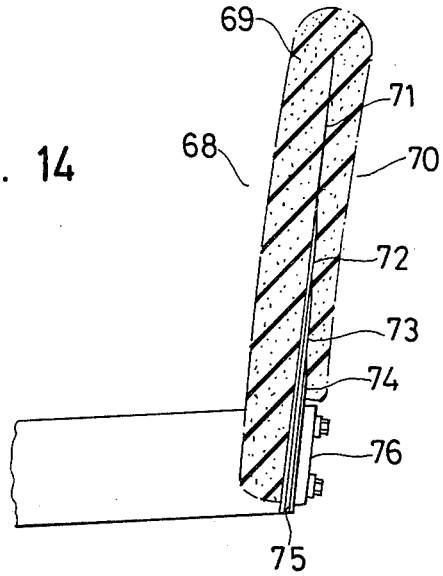

FIG. 14 represents a side view and a section of a body for forming the back of a chair or similar piece of furniture.

FIG. 15 illustrates a side view and a section of a body according to the invention which is suited for forming a surface to sit on.

FIG. 16 is a side view and a section of a body according to the invention suited for a sofa, a chair, or similar piece of furniture.

FIG. 17 is a development of a plate-shaped body according to the invention.

Figure 18:
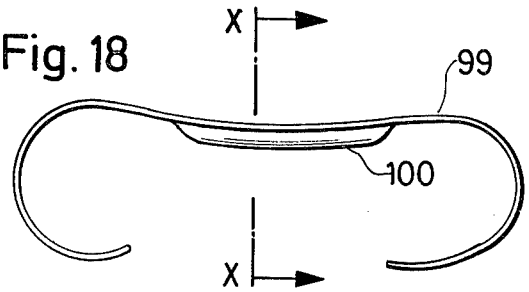

FIG. 18 illustrates a side view of another body according to the invention having reinforcing corrugations.

Figure 6:
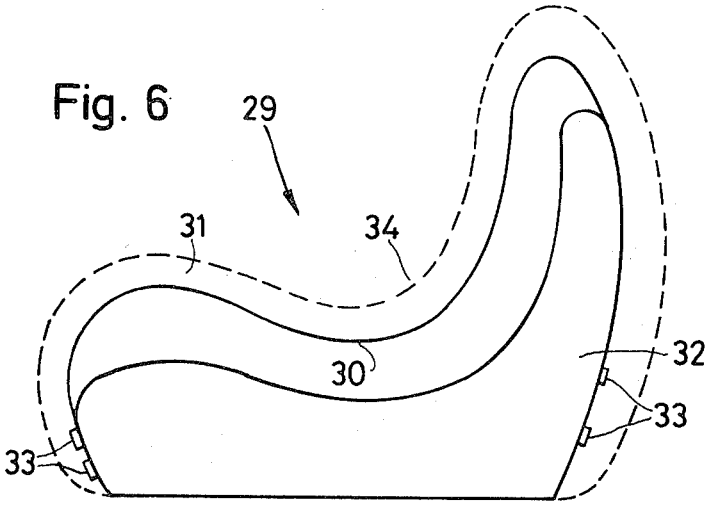
FIG. 6 represents another chair or similar piece of furniture with a single upholstering body according to the invention.
Figure 19:
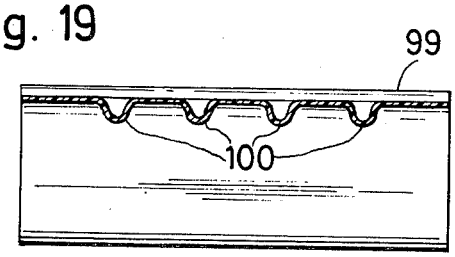

FIG. 19 illustrates a front view of FIG. 6 sectioned along the line X — X of FIG. 18.

Figure 20:
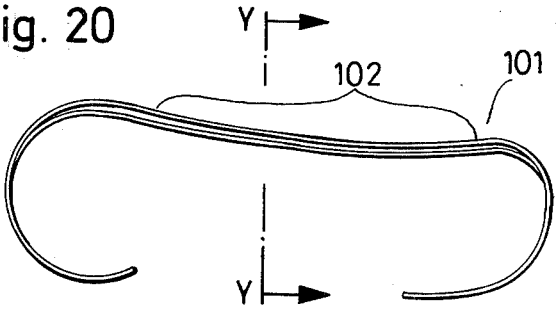

FIG. 20 represents a side view of a further body according to the invention with bands for stiffening the seat surface.

Figure 21:
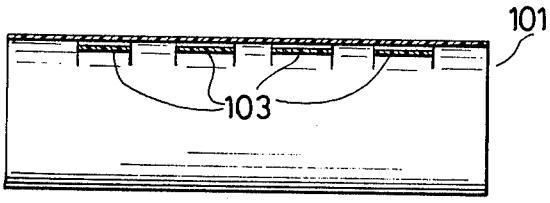

FIG. 21 represents a section taken along the line Y — Y of FIG. 20.

Figure 22:
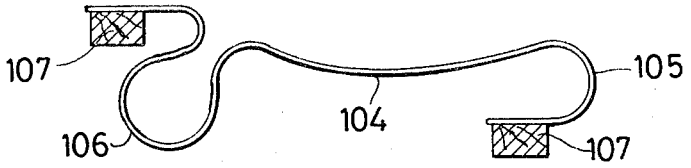

FIG. 22 shows in side view and in section a further advantageous embodiment of a body according to the invention forming a seat surface.

Figure 23:
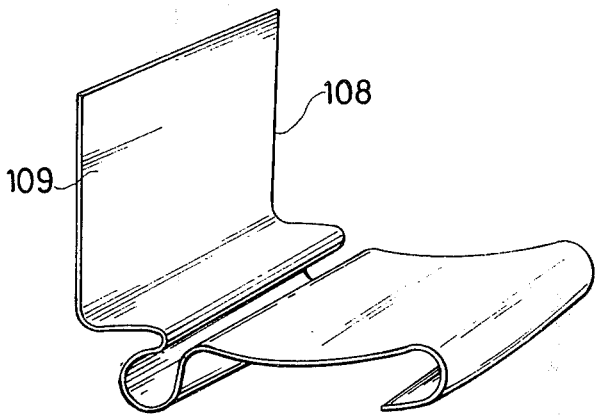

FIG. 23 is an isometric view of a body according to the invention which corresponds substantially to the body of FIG. 22 but is intended for forming the back and is provided with a formed-on extension.

Figure 24:
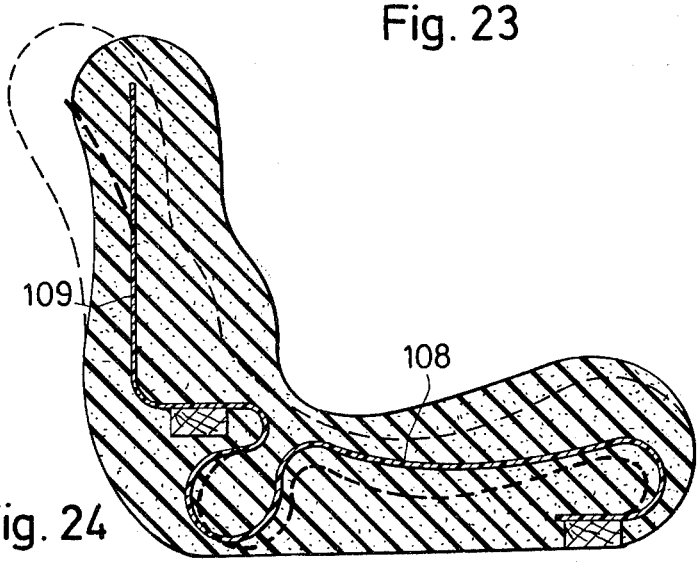

FIG. 24 represents a side view of a furniture piece which was made while employing the body of FIG. 23.

Figure 25:
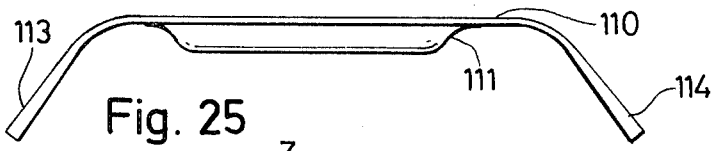

FIG. 25 illustrates in side view a body according to the invention after its manufacture and intended to form a surface to sit or rest on.

Figure 26:
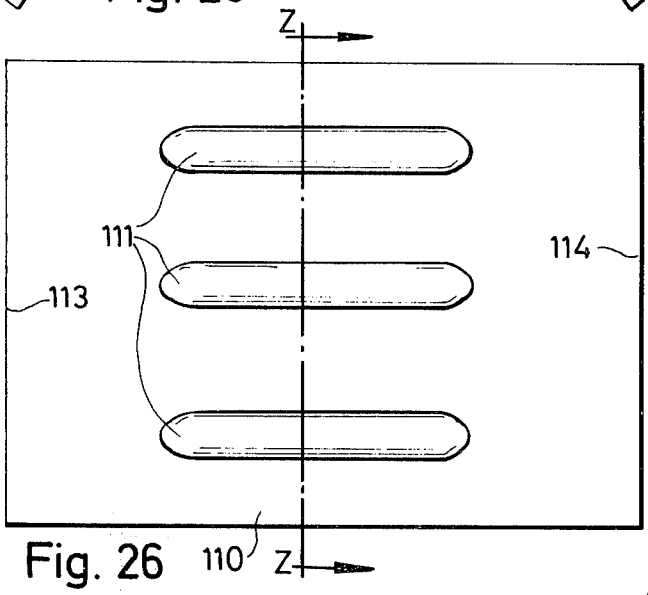

FIG. 26 shows a bottom view of the body of FIG. 25.

Figure 27:
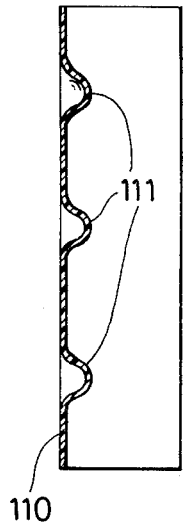

FIG. 27 illustrates a front view of the body of FIG. 25 sectioned along the line Z — Z of FIG. 26.

Figure 28:
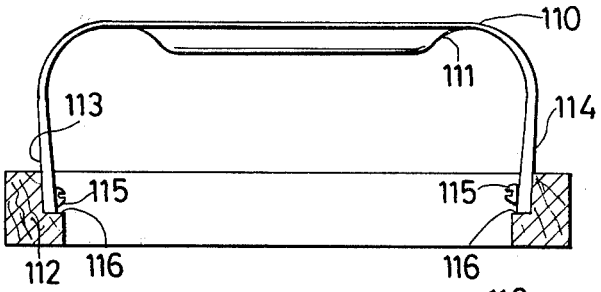

FIG. 28 illustrates the body of FIGS. 25 to 27 in a condition as it results when it is tightened over a frame but is not loaded.

Figure 29:
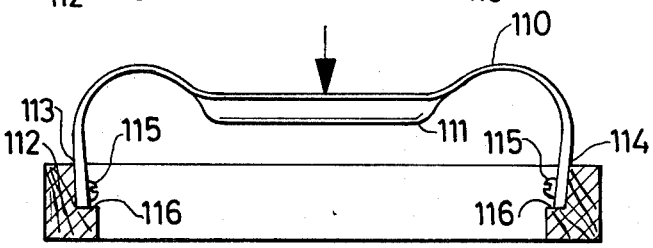

FIG. 29 shows the body of FIG. 28 stretched over a frame with the sitting or resting surface under load.

The upholstering body according to the present invention, which is provided with a core of thin-walled synthetic material and with an upholstering layer of foam material, is characterized primarily in that the core comprises a plane or corrugated body which when developed forms a substantially rectangular plate-shaped body of synthetic material, preferably of glass fiber reinforced synthetic material, especially polyester, said body being resiliently yieldable in the intended load direction substantially only in one plane of movement which is parallel to the direction in which the upholstering body is to be subjected to a load.

The advantage of an upholstering body according to the present invention consists primarily in that the plate-shaped body, especially made of glass fiber reinforced polyester is able to absorb very high loads and in view of the high elasticity of the compound material has an excellent spring behavior. For purposes of making the plate-shaped body, no expensive deep drawing tools or similar tools are necessary. The plate-shaped body according to the invention can be produced in a simple manner by means of a correspondingly curved steel sheet serving as form. This method also permits an economic production of even a small number of pieces of an upholstering body.

The upholstering body according to the present invention furthermore excels in a relatively soft spring and the movability of the surface to be loaded in a direction perpendicular to the direction in which the load acts upon the upholstering body.

Preferably, the upholstering bodies according to the present invention are employed for making chairs, seats or the like, which have a frame of wood, or the like. With furniture pieces of this type it is expedient that the plate-shaped body of the upholstering body according to the invention is within the region of at least one of the two edges extending transverse to the plane of movement connected to or on the frame. In this way, the location of the plate-shaped body relative to the frame is defined. However, it is also possible to insert an upholstering body according to the invention merely into a correspondingly dimensioned frame without any connection with the frame.

According to a further development of the present invention, it is suggested that for forming the back of the plate-shaped body, the plate-shaped body is substantially plane with the exception of areas which are adapted to certain physiological requirements. When the plate-shaped body has a thickness of, for instance, 5 millimeters, an entirely sufficient support of the back is obtained with a not too soft spring. In order to create a favorable connecting possibility with regard to the forces occurring on the plate-shaped body, it is suggested according to a further feature of the invention at one end of the plate-shaped body to provide flange-shaped extensions which extend substantially parallel to the plane of movement, for purposes of connecting the body to the frame. For purposes of saving foamed material when preparing the back, it is suggested to design the plate-shaped body substantially as a closed hollow body.

A seat, or the like, employing the upholstering body according to the invention, can be produced with particularly low cost when the plate-shaped body is formed of one integral piece while being adapted to physiological requirements.

In order further to improve the spring behavior of the core and of the plate-shaped body for the upholstering body, and furthermore in order to reduce the costs for making such plate-shaped body, it is suggested to have the thickness of the plate-shaped body increase in the direction toward the mounting area or areas on the frame, preferably by employing a plurality of laminates of glass fiber reinforcement and polyesters. In view of the thickness, for instance, 2 millimeters of the body made of polyester laminate or the like, in its central range, over the thickness of the previously described plate-shaped bodies the spring is not only softer, but the finished upholstered body will when being subjected to loads better adapt itself to the body exerting the load. With increasing load, the spring hardness increases progressively while the load is absorbed by the reinforced thicker ends of the body. In addition thereto, considerable saving in material and working time is realized over the above described bodies when manufacturing the last mentioned body because the latter consists primarily only of one or two continuous polyester laminates which merely within their mounting region are reinforced by placing thereupon laminates which are considerably smaller in surface. It has been found that the strength of a plate-shaped body produced in this way is completely sufficient under normal load conditions. When making plate-shaped bodies of the initially described type, in contrast thereto, for instance, four or five continuous laminates are employed. The saving alone in working time with the last mentioned body amounts to approximately 50% over the previously described bodies.

According to still a further development of the upholstery body according to the invention, it is suggested that with a plate-shaped body with an arched extension continued within the region of the respective mounting area, the thickness of the plate-shaped body increases within the region of this extension. With such an arrangement, bending stresses occur substantially only within the region of the arched-shaped extensions of the body.

According to still a further improvement of the present invention, the plate-shaped body may when being supported on both ends be connected to the frame while being subjected to pull stresses. Such an arrangement permits the setting of a certain base hardness without materially changing the advantageous spring behavior of the body. A certain hardness in a portion of the body can be obtained in conformity with the present invention by providing beads or ribs in or on the plate-shaped body, which beads or ribs have their longitudinal extension in a direction transverse to the mounting area or transverse to the respective portion of the frame.

Figure 1:
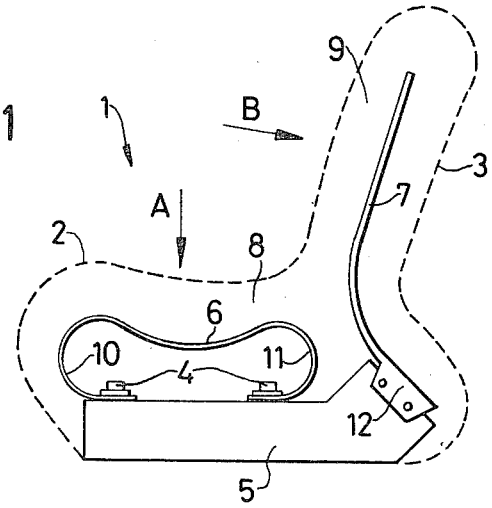
FIG. 1 illustrates a side view of a furniture piece employing upholstering bodies according to the invention.

Referring now to the drawings in detail, the chair illustrated in FIG. 1 is generally designated with the reference numeral 1. The chair 1 is composed primarily of upholstering bodies 2 and 3 which, by means of screws 4, are connected on or to a frame 5 consisting of wood, or the like. The upholstering bodies 2 and 3 consist of a core 6, 7 respectively, and form an undulated or plane body, the development of which, represents a substantially rectangular plate-shaped body.

This body is made of synthetic material, preferably of glass fiber reinforcing synthetic material, especially polyester, on which an upholstering layer 8, 9 is arranged. The layers 8 and 9 may be connected to the cores 6 and 7 respectively by cementing, glueing, or the like. The contour of the upholstering layers 8 and 9 is illustrated in FIG. 1 by dash lines. The plate-shaped body of the upholstering body 2 which forms the core 6 ends on oppositely located sides in arched extensions 10, 11, the free ends of which point in opposite directions, and extend as to their width in directions transverse to the plane of movement. In this way, an excellent spring behavior of the upholstering body is obtained while simultaneously a certain possibility of movement of the body 2 transverse to the direction of load indicated by the arrow A is realized. The plate-shaped body of the upholstering body 3, which plate-shaped body forms the core 7 has one end provided with flange-like extensions 12 which extend in planes approximately parallel to the plane of movement, said flange-like extensions 12 are provided for connecting the core 7 to the frame 5. The core 7 is resiliently yieldable in the load direction which is indicated by the arrow B. When suitably selecting materials for making the plate-shaped bodies for the cores 6 and 7 and when selecting a suitable wall thickness for the cores 6 and 7, there will in combination with a suitable foamed material employed as upholstering layer be obtained a chair, or similar furniture piece which in addition to being able to absorb a high load will also offer a surprisingly high sitting comfort even though it can be produced with a relatively small amount of materials and within a minimum of time.

Figure 2:
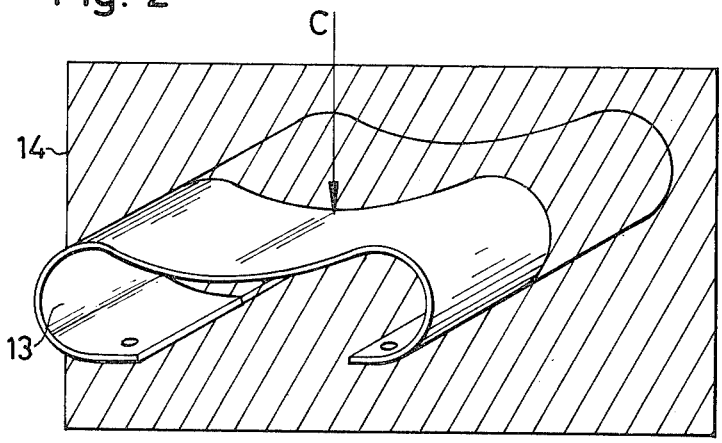
FIG. 2 illustrates a plate-shaped body employed for making an upholstering body according to the invention, and also shows the plane of movement in which the plate-shaped body is resiliently yieldable.

The plate-shaped body 13 illustrated isometrically in FIG. 2 corresponds substantially to the plate-shaped body which is employed as core 6 for the upholstering body 2 of FIG. 1. The direction of those forces as a result of which the body 13 is resiliently yieldable is indicated by an arrow C. The location of one plane of movement which represents one of an infinite number of planes which are, at least approximately parallel to each other, is indicated by means of the shaded surface 14.

Figure 3:
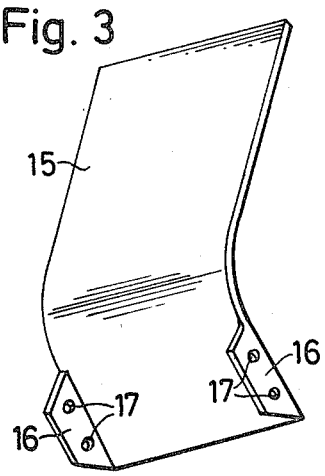
FIG. 3 shows a plate-shaped body according to the invention for use as core for the back of a chair or similar piece of furniture.

The plate-shaped body 15 illustrated as an isometric view in FIG. 3 corresponds to a plate-shaped body which serves as core 7 for the upholstering body 3. The flange-shaped extensions 16 have bores 17 for connecting the body 15 to a corresponding frame. That part of the body 15 which is located above the region of the extension 16 may without difficulties be undulated in order in this way to bring about a better adaptation to physiological requirements when the seat, or the like furniture piece, is being made.

Figure 4:
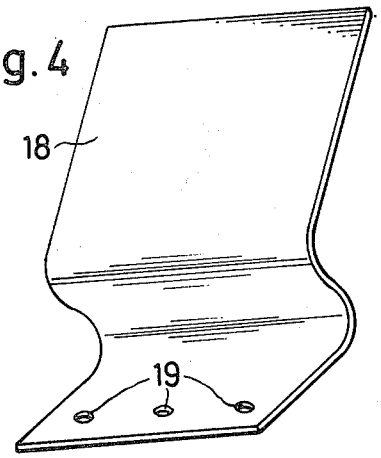
FIG. 4 represents another plate-shaped body according to the invention for use as core for the back of a chair or similar piece of furniture.

The plate-shaped body 18 illustrated in FIG. 4 and adapted to be employed instead of the plate-shaped bodies 15 as a back for a seat, or the like, has within the region of that end which is provided with bores 19 for connection to a frame, and approximately S-shaped contour for obtaining a softer spring behavior.

Figure 5:
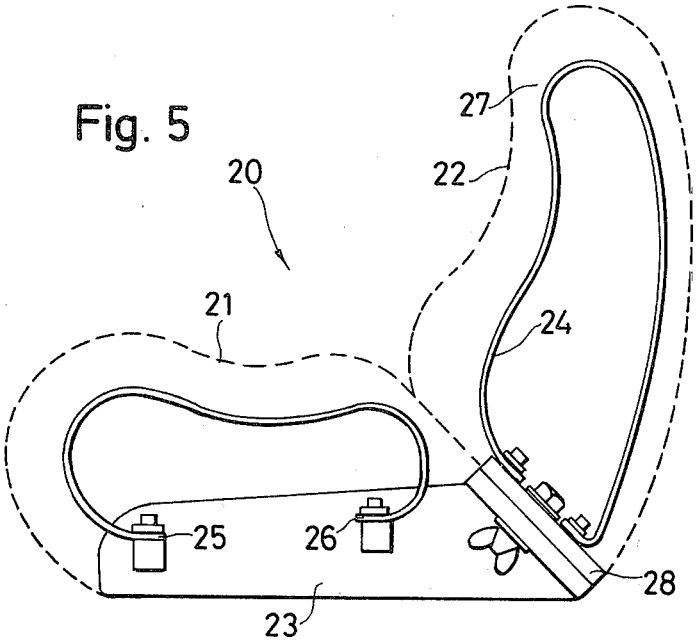
FIG. 5 illustrates a side view of a further chair or similar piece of furniture with upholstering bodies according to the invention.

FIG. 5 illustrates a seat 20 which comprises substantially upholstering bodies 21 and 22 which are connected on or to a frame 23. The upholstering body 21 substantially corresponds to the upholstering body 2 of the seat 1 of FIG. 1, whereas the upholstering body 22 for forming the back has a core 24 which is designed substantially as a closed hollow body. On the ends 25, 26 which are located opposite to each other, the plate-shaped body forming the core 24 is, by means of nonillustrated screws or other connecting elements firmly connected to the frame 23. The upholstering body 22 has over the upholstering body 9 for the back of the furniture piece of FIG. 1 the considerable advantage that considerably less quantities of foamed material are necessary for the upholstering layer 27, in order to obtain a certain thickness of the back. The upholstering body 22 is furthermore connected to a plate 28 which is detachably connected to the frame 23.

FIG. 6 shows a seat 29 which consists primarily of a core 30 with an upholstering layer 31 of foamed material and lateral parts 32. The core 30 with the upholstering layer 31 is, by means of connecting elements 33, connected to the side parts 32. A separate frame is not necessary. The free distance between the core 30 and the edges of the lateral parts 32, which edges face the core 30 is so dimensioned that the upholstering body 34 which consists of core 30 and upholstering layer 31 does not impact upon or against the respective upholstering bodies 34 or the respective edges of the lateral parts 32. When too great a load is exerted upon the seats 29, the respective edges of the lateral parts 32 may serve for absorbing forces or the support for the upholstering body 34. The lateral parts 32 may, for instance, be made of plywood having a thickness of approximately 20 millimeters.

Figure 7:
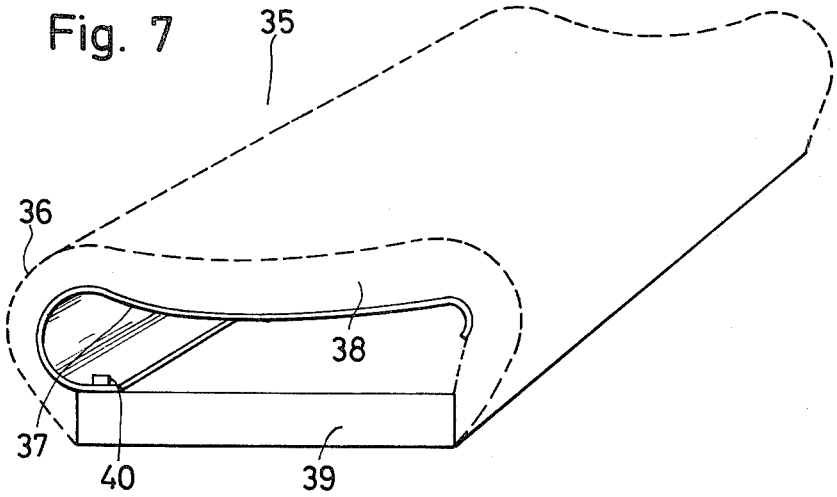
FIG. 7 illustrates a sofa or similar piece of furniture which employs an upholstering body according to the invention.

FIG. 7 is an isometric view of a lounging furniture piece 35 which consists primarily of a polyester body 36 with a core 37 and polyester layer 38, all designed in conformity with the present invention. The upholstering body 36 is connected to a frame 39. The core 37 forms a nearly closed hollow body. The lower end shown in FIG. 7 of the furniture piece shown in FIG. 7 is, by means of connecting elements 40, connected to the frame 39. The upper end is designed free swinging. In order to cushion the thus obtained springiness which is considerably softer than the design of the core according to upholstering 2 of FIG. 1, without varying the properties of the resilient element proper, the space between the upper portion and the lower portion of core 37 may be filled with a suitable foamed material.

Figure 8:
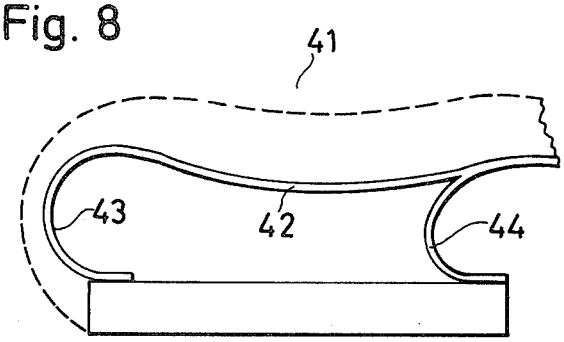
FIG. 8 represents a further embodiment of an upholstering body according to the invention for a chair or similar piece of furniture.
Figure 9:
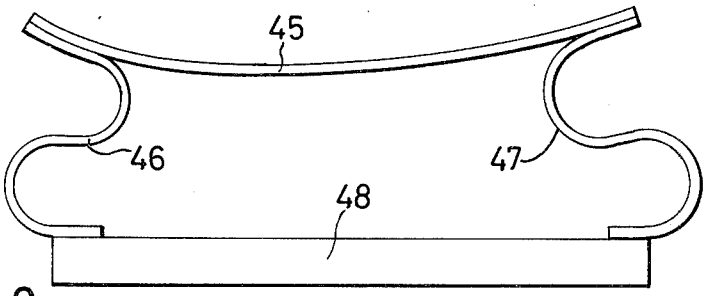

FIG. 8 shows another embodiment of an upholstering body which is preferably employed for a sitting furniture piece. The upholstering body 41 for absorbing the vertically directed loads of the seat furniture piece corresponds as to its behavior substantially to the upholstering 2 of the furniture piece 1 of FIG. 1. The core 42 ends in contrast to the core 6 of FIG. 1 into extensions 43 and 44, the free ends of which point in the same directions. This shape of an upholstering body according to the invention permits a compact construction which may be advantageous, for instance, when making chairs, or the like. FIG. 9 illustrates a core for a lounging furniture piece which comprises a plate-shaped body 45 with S-shaped extensions 46 and 47. The extensions 46 and 47 are at one end connected to the plate-shaped body 45 and on the other end are firmly connected to a frame 48. Such design of the core for a lounging furniture piece yields a high elasticity of the upholstering body provided with such core, in vertical direction and also in horizontal direction.

Figure 10:
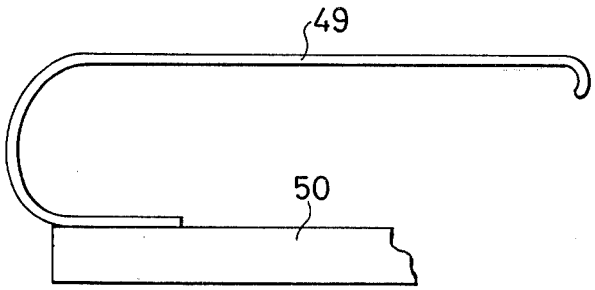

FIG. 10 shows another possible core for an upholstering body according to the invention, for use in connection with lounging furniture pieces. The plate-shaped body 49 which forms the core has a substantially U-shaped cross section while one end if firmly connected to a frame 50.

Figure 11:
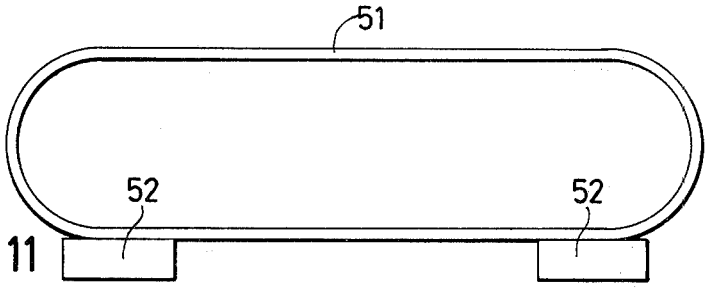

The body 51 illustrated in FIG. 11 may likewise serve as core for a lounging furniture piece. When correspondingly dimensioning the wall thickness of the plate-shaped body 51, there will also with this design be obtained a satisfactory elasticity relative to loads acting in a substantially vertical direction. For purposes of supporting the plate-shape body 51 when the latter is employed as core for the upholstering body of a lounging furniture piece, legs 52 will suffice.

Figure 12:
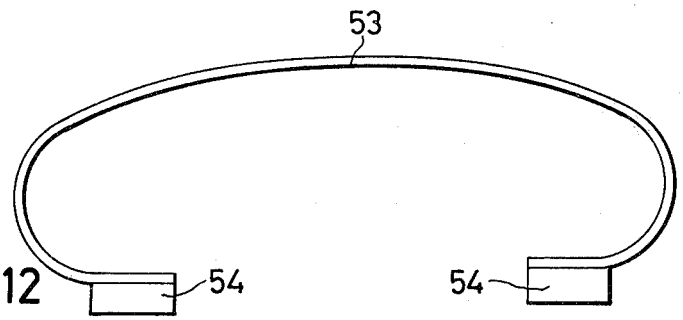

Another possible embodiment of a plate-shaped body as core for the upholstering body of a lounging furniture piece is illustrated in FIG. 12. The plate-shaped body 53 is, in this instance, of C-shaped design and has both ends resting on legs 54. FIG. 13 shows a plate-shaped body 55 which, by means of screws 56, is connected to spars 57 which, in their turn, are mounted on a frame 58. The plate-shaped body 55 consists of a continuous polyester laminate 59 which at its central region 60 together with the foamed material thereabove forms, for instance, a seat surface and with its ends 62 which form the supporting areas is connected to the spars 57. Within the region of the arched extensions 63, further laminates 64 – 67 are so mounted on the polyester laminate 59 that the laminates 64 – 67 are firmly connected to the laminate 59.

When the region 60 of the body 55 is under load, at those areas where the arched extensions 63 are located, bending stresses occur which are absorbed by the laminates 59 and 64 – 67 which are here arranged one above the other. Inasmuch as the laminate 59 is relatively thin, for instance 2 millimeters, it is expedient for obtaining a certain basic hardness of the spring element formed by the body 55, to connect the body 55 at a certain pulling stress to the spars 57 or frame 58. To this end, for instance, the spars 57 may be displaceably mounted on frame 58 in the indicated direction. However, it is also possible to connect the body 54 in its correspondingly tensioned condition on the stationary spars 57 or frame 58.

The back 68 illustrated in FIG. 14 and pertaining to a nonillustrated chair, in addition to having a layer 69 of foamed material also comprises a body 70 which consists of a continuous polyester laminate 71 and additional laminates 72 – 74 which are firmly connected to the laminate 71. The laminates 72 – 74 extend over the entire width of the back 68 or laminate 71 and have a progressively decreasing longitudinal extension (extension in the height of the back 68). The laminates 72 – 74 are applied to the laminate 71 in such a way that the body 70 formed by these laminates will, toward the end 75, increase in its thickness. In view of this construction a comfortable spring behavior is obtained with a sufficient bend resistance of the body 70 within the region of the mounting area 76.

FIG. 15 illustrates a body 77 which may be used for a furniture piece with a seat, said body 77 together with a foamed layer 78 forming a polyester body. The body 77 has a continuous polyester laminate 79 with additional laminates 80 – 82 arranged on both sides and decreasing in length progressively. At one end there are provided the laminates 80 – 82 within the region of an arched extension 83, whereas the other end of body 77 is substantially plane and the laminates 80 – 82 serve as reinforcement of this area or region of the body 77.

Also, the body 77 may be connected to the spars 84 while being subjected to pull stresses.

FIG. 16 illustrates a body 85 which is provided with a layer 86 of foamed material for producing a lounge 87 or a seat. The body 85 consists of a continuous polyester laminate 88 and of additional laminates 89 – 91 which in conformity with the above described embodiments of the invention progressively reinforce the body 85 towards the ends or bearing areas 93. The body 85 is preferably under pull tension between oppositely located supporting areas 93 connected to the frame 92.

FIG. 17 shows a top view of a plate-shaped body. The body 94 according to FIG. 17 consists of a continuous polyester laminate 95 and of additional laminates 96 – 98 which are applied at opposite ends to the laminate 95 and which progressively reinforce the ends. The individual laminates 95 – 98 are made preferably while employing glass fiber fabric. In cases that the laminates are subjected only to minor stresses, also glass fiber mats may be employed.

The body 99 according to FIGS. 18 and 19, which is illustrated only diagrammatically, is provided with corrugations 100 for obtaining a certain hardness of the central area of the supporting surface formed by the body. The result obtainable with such corrugations is, however, not the same as tensioning of a body in conformity with the above described designs and without the employment of corrugations. This applies, in particular, to the spring behavior.

FIGS. 20 and 21 diagrammatically illustrate a body 101 in which, for purposes of stiffening the intermediate range or the supporting surface 102, there are provided band-shaped polyester laminates 103 which are located parallel adjacent to each other.

The body 104, according to FIG. 22, ends at that end which is opposite to the front side with the arched extension 105 in an approximately tubular extension 106, the free end of which, is like the free end of the arched extension 105, connected to a spar 107. With this body 104 which is illustrated only diagrammatically, it is also possible in combination with a certain pull tension between the two free ends of the body 104 to obtain a comfortable spring behavior with increasing soft springiness toward the rear end with the extension 106.

FIG. 23 shows an isometric view of a body 108 which corresponds to the body 104 of FIG. 22, with the exception of the additionally formed-on back portion 109.

A furniture piece with a seat while employing the body 108, is diagrammatically illustrated in FIG. 24. The dash line portion relates to an instance in which the furniture piece is under load.

There exists, however, the possibility to produce the article according to the invention merely by employing a suitable synthetic material. In view of the particularly satisfactory strength properties, easy workability, good aging resistance, and last but not least, in view of the very favorable manufacturing costs, it is suggested that for purposes of making a body according to the invention, to produce a continuous polyester laminate of polyester resin and glass fiber, preferably glass fiber fabric manually or mechanically on a form which corresponds to the plate-shaped body. At least a further laminate is then applied to said polyester laminate within the region of the ends for the connection on the frame while the side facing away from the form has a still sticky surface. In this connection, it is expedient to connect the thus produced body to a frame under pull stresses in order with a relatively high basic hardness of the upholstering body nevertheless to obtain a soft spring with regard to dynamic loads.

It is also possible to produce the plate-shaped body which forms the core of the polyester body, of suitable steel sheet metal instead of polyester laminates. The drawback in connection with the use of steel sheet metal consists in that the shaping is more difficult and the corrosion resistance is lacking while the manufacturing costs are higher.

The plate-shaped body according to FIGS. 25 – 29 likewise consist of polyester laminates. In the drawings there is illustrated by correspondingly heavier lines, the increase in the number of the superimposed laminates. The plate-shaped body 110 illustrated in FIGS. 25 – 29 has within the region serving as seat or lounging surface a plurality of corrugations, of the like, 111 which are arranged adjacent to each other and which serve for reinforcing the seat or lounging surface and which, in case this surface is subjected to a load, bring about a uniform lowering of the entire central surface. This represents an advantageous effect, particularly when the load acts unilaterally on a relatively small surface.

The free ends 113 and 114 of the body 111 which are to be connected to a frame 112 form after their manufacture a V-shaped angle. For purposes of manufacturing an upholstering body or furniture piece, the ends 113 and 114 are bent towards each other to such an extent that these ends extend substantially parallel to each other. In this condition, i.e. while being under a bending tension, the body 110 is connected to the frame 112, for instance, by means of wood screws 115. For purposes of receiving the free ends 113 and 114 of the body 110, grooves, recesses, reinforcements, or the like, 116 may be provided in the frame 112. According to FIG. 28, the body 110 is illustrated on the frame 112 in tension condition without an outer load, whereas FIG. 29 shows the body 110 in an instance in which the load acts in a direction indicated by the arrow.

In contrast to the embodiment of FIG. 13, the preload of the plate-shaped body is, in this instance, not obtained by a pulling stress, but by a bending stress. By employing this principle, saving in material and time can be realized when manufacturing the body and mounting the same on a frame.

It is, of course, to be understood that the present invention is, by no means, limited to the specific showings in the drawings, but also comprises any modifications within the scope of the appended claims.

What is claimed is:

1. A body for use in upholstering and comprising in combination: a layer of resilient material forming the outer part of the body, and core means supportingly engaging the inner side of said layer, said core means comprising at least one sheet exclusively of continuous synthetic material, said sheet including means for anchoring the sheet to the frame of an article of furniture, said sheet being resiliently yieldable in the direction in which a load is normally imposed thereon and being resistant to yielding also in other directions.

2. A body in combination according to claim 1 in which said sheet when viewed in the direction of a normally applied load is substantially rectangular.

3. A body in combination according to claim 1 in which said sheet contains reinforcing fibers.

4. A body in combination according to claim 1 in which said sheet is reinforced by glass fibers.

5. A body in combination according to claim 1 in which said sheet has opposite edge regions turned toward each other over respective arcs and on the same side of said sheet, each edge region extending the full width of said sheet, said edge regions comprising said means for anchoring said sheet to a frame.

6. A body in combination according to claim 1 in which said means for anchoring said sheet to a frame is disposed along one edge of the sheet.

7. A body in combination according to claim 1 in which said sheet is substantially planar.

8. A body in combination according to claim 7 in which said sheet comprises flange means at one end extending therefrom substantially in the plane of said sheet and comprising the means for anchoring said sheet to a frame.

9. A body in combination according to claim 1 in which said body is adapted for use as the back of a furniture article and said sheet is formed as a closed hollow body.

10. A body in combination according to claim 1 in which said body is adapted for use as the seat and back of an article of furniture and said sheet is formed to an angular contour so as to extend substantially horizontally along the seat and then upwardly along the back of the body.

11. A body in combination according to claim 1 in which said sheet has at least one edge extending transversely to the plane of movement of the sheet when loaded and comprising the means to anchor the sheet to a frame.

12. A body in combination according to claim 11 in which said sheet is in the form of a hollow body.

13. A body in combination according to claim 1 in which said sheet increases in thickness toward said means for anchoring the sheet to a frame.

14. A body in combination according to claim 13 in which said sheet is laminated in at least the region of said anchoring means.

15. A body in combination according to claim 1 in which said sheet has at least one edge region formed to an arc of substantial size, said region being laminated and increasing in thickness toward the margin thereof.

16. A body in combination according to claim 1 in which said sheet has thickened edge regions curved so the margins oppose each other, said edge regions near the margins thereof comprising the means to anchor said sheet to a frame, said sheet when anchored to a frame placing the thinner intermediate region thereof under tension.

17. A body in combination according to claim 1 in which said sheet includes rib means extending longitudinally thereof in at least the region of the sheet to which a load is applied.

18. A body in combination according to claim 1 in which said layer of resilient material is a foamed material.

19. A body in combination according to claim 1 in which said synthetic material is polyester resin.

* * * * *